US006405714B1

(12) United States Patent
Bylsma et al.

(10) Patent No.: US 6,405,714 B1
(45) Date of Patent: Jun. 18, 2002

(54) METHOD AND APPARATUS FOR CALIBRATING AND CONTROLLING FUEL INJECTION

(75) Inventors: Philip J. Bylsma, Brookfield; David B. Koen, Milton; Andrew E. Kronquist, Janesville; Patrick Robert Taylor, Elkhorn, all of WI (US); Eric A. Criteser, Libertyville, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/570,096

(22) Filed: May 12, 2000

(51) Int. Cl.[7] ..... F02M 51/00
(52) U.S. Cl. ..... 123/480; 123/490
(58) Field of Search ..... 123/480, 490; 361/152, 153

(56) References Cited

U.S. PATENT DOCUMENTS 5,711,280 A * 1/1998 Foerster et al. ..... 123/490
6,005,763 A * 12/1999 North ..... 123/490
6,047,683 A * 4/2000 Siegl ..... 123/478
6,138,642 A * 10/2000 Zhang et al. ..... 123/478
6,273,068 B1 * 8/2001 Joos et al. ..... 123/295

* cited by examiner

*Primary Examiner*—John Kwon
(74) *Attorney, Agent, or Firm*—Fletcher, Yoder & Van Someren

(57) ABSTRACT

A method for calibrating an electronic control unit for an internal combustion engine. The electronic control unit may have multiple channels with each channel being adapted to provide an input drive signal to a fuel delivery apparatus. A first channel is selected for calibration. A reference signal of desired and known parameters is also defined. The reference signal is defined such that it is indicative of the cyclical performance of a fuel delivery apparatus such as a fuel injection device. A command signal is generated and passed through the circuitry of the selected channel. The channel circuitry generates a drive signal in response to the command signal. A desired parameter of the drive signal is measured for comparison with the known parameter of the reference signal. If necessary, the command signal is then adjusted so as to produce a modified drive signal which has a parameter with reduced variation from the known reference parameter.

24 Claims, 5 Drawing Sheets

METHOD AND APPARATUS FOR CALIBRATING AND CONTROLLING FUEL INJECTION

BACKGROUND OF THE INVENTION

1. Field of the Invention

The present invention relates generally to a method and apparatus for controlling the performance of an internal combustion engine. More specifically, the present invention relates to a technique for calibrating components used to control a fuel injection system of in internal combustion engine to enhance consistency and predictability in the performance of the engine.

2. Description of the Related Art

Internal combustion engines are used to provide mechanical power in a number of applications. Some of the more recognized uses include automobiles, motorcycles, watercraft, and so forth. Other uses range from small engine applications such as lawn mowers to large scale applications including industrial machinery. An internal combustion engine operates by igniting a mixture of air and combustible fuel within one or more combustion chambers to provide rotational motive force, or torque, to do work. For example, in an automobile, the engine provides torque to the wheels to impart a driving force to the vehicle. Likewise, when used in a watercraft, the engine is typically coupled to a prop which, when rotated, provides a thrust to the watercraft.

Engine performance is greatly dependent upon proper fuel delivery to the combustion chamber. For example, the torque produced by an engine is generally proportional to the volume of fuel introduced into the combustion chamber for a given combustion cycle. Engine speed, on the other hand, is generally a function of the flow rate of fuel to the combustion chamber. Under typical operating conditions, accurate and predictable control of both torque and engine speed is desired. Thus, the fuel delivery system is an integral and extremely important component in engine performance.

There are many methods of providing fuel to a combustion chamber in an internal combustion engine. One of the more widely utilized methods is fuel injection. While discussed in broad terms here, fuel injection may also be broken down into numerous techniques and methods. Typically, fuel injection involves employing one or more pumps to provide a source of pressurized fuel. A fluid actuator, such as a solenoid operated valve, initiates a flow of pressurized fuel to an injection nozzle. In other systems the fluid actuators produce a surge in fuel pressure. The surge in pressure then causes the injection nozzle to open, allowing pressurized fuel to flow through the injection nozzle into the combustion chamber. Some types of injection systems may integrate the pump and injection nozzle into a single unit. In such a case, the pump is electrically operated and controlled to deliver desired volumes of pressurized fuel at desired rates.

Regardless of the type of injection being used, proper timing and control of the injection event becomes critical. Improper fuel volumes, rates of delivery, cycle times, or timing of the injection with the spark ignition in the combustion can all lead to poor engine performance. Typically, a programmable logic device, or an electronic control unit, controls the operation of the fuel injection system. Through appropriate circuitry, the programmable logic device generates signals to be sent to the fluid actuators or pumps, depending on the system type. These signals control the operation of the fluid actuators or pumps to deliver the right amount of fuel through the nozzle at the appropriate time.

In modern fuel injection systems, numerous factors may contribute to inconsistent and unpredictable performance of a fuel delivery system. Stacking of tolerances in the mechanical components may serve to create unpredicted performance of the pump, fluid actuator, or nozzle assemblies. Likewise, stiction within any of the above mentioned components may lead to unpredictability and inefficiency. Furthermore, in most cases, an engine requires multiple injection devices and associated actuators or pumps, typically one for each combustion chamber. In such instances, variances in the injection control components or circuitry from one combustion chamber (or control channel) to another complicates the matter even further. Variances in the controller continue to add to the unpredictability. For example, the controller often employs channels for the control of the injection devices. Each device is controlled by its own individual channel. Because of tolerances in the components used in each channel's circuitry, there may be slight variances in signals produced from channel-to-channel. Such variations, although small, may significantly affect engine performance, particularly at lower per cycle injection rates. Moreover, such variations may also result in higher exhaust emissions, which in most cases are preferably kept to a minimum.

There is, therefore, a need in the art for the ability to improve fuel injection systems such that fuel delivery is consistent and predictable. These improvements should not only be in terms of cyclic performance (i.e. between cycles), but also from one channel to another channel—or from one combustion chamber to another combustion chamber—within a given internal combustion engine (i.e. within each cycle).

SUMMARY OF THE INVENTION

The present invention is directed to overcoming, or at least reducing the affects of, one or more of the problems set forth above. The technique offers a simple and straightforward way to compensate for part-to-part differences, to provide significantly improved engine performance, excellent predictability in operation, and reduced emissions.

The technique provides a method of calibrating an electronic control unit for an internal combustion engine. The electronic control unit may have multiple channels with each channel being adapted to provide an input drive signal to a fuel delivery apparatus. In accordance with one aspect of the technique, a first channel is selected for calibration. A reference signal of desired and known parameters is defined such that it is indicative of the desired performance of a fuel delivery apparatus such as a fuel injection device. A command signal is generated and applied to the selected channel. The channel circuitry then generates a drive signal in response to the command signal. A desired parameter of the drive signal is measured for comparison with the known parameter of the reference signal. If necessary, the command signal is then adjusted so as to produce a modified drive signal which has a parameter with reduced variation from the known reference parameter.

The process of adjusting the command signal may be accomplished by changing the duration of the command signal by a predetermined increment of time. The process may then become iterative until the modified drive signal has a parameter which comes within an acceptable range when compared to the known reference parameter. The total adjustment to the command signal is then stored into a memory device for subsequent recall. Having calibrated the selected channel, another channel may be selected and the process repeated until all channels of the electronic control unit are calibrated.

In accordance with another aspect of the invention, an electronic control unit is provided for control of a fuel delivery system on an internal combustion engine. The electronic control unit includes a microprocessor with a memory storage device coupled to the microprocessor. A driver circuit is also coupled to the microprocessor. The driver circuit includes multiple channels with each channel providing a drive signal to a fuel delivery apparatus in response to a command signal from the microprocessor. The command signal is augmented by a customized parameter offset. The customized parameter offset assists to produce a drive signal with a predetermined characteristic.

In accordance with another aspect of the invention, an internal combustion engine is provided having an electronic control unit with the qualities and components of those described above herein.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
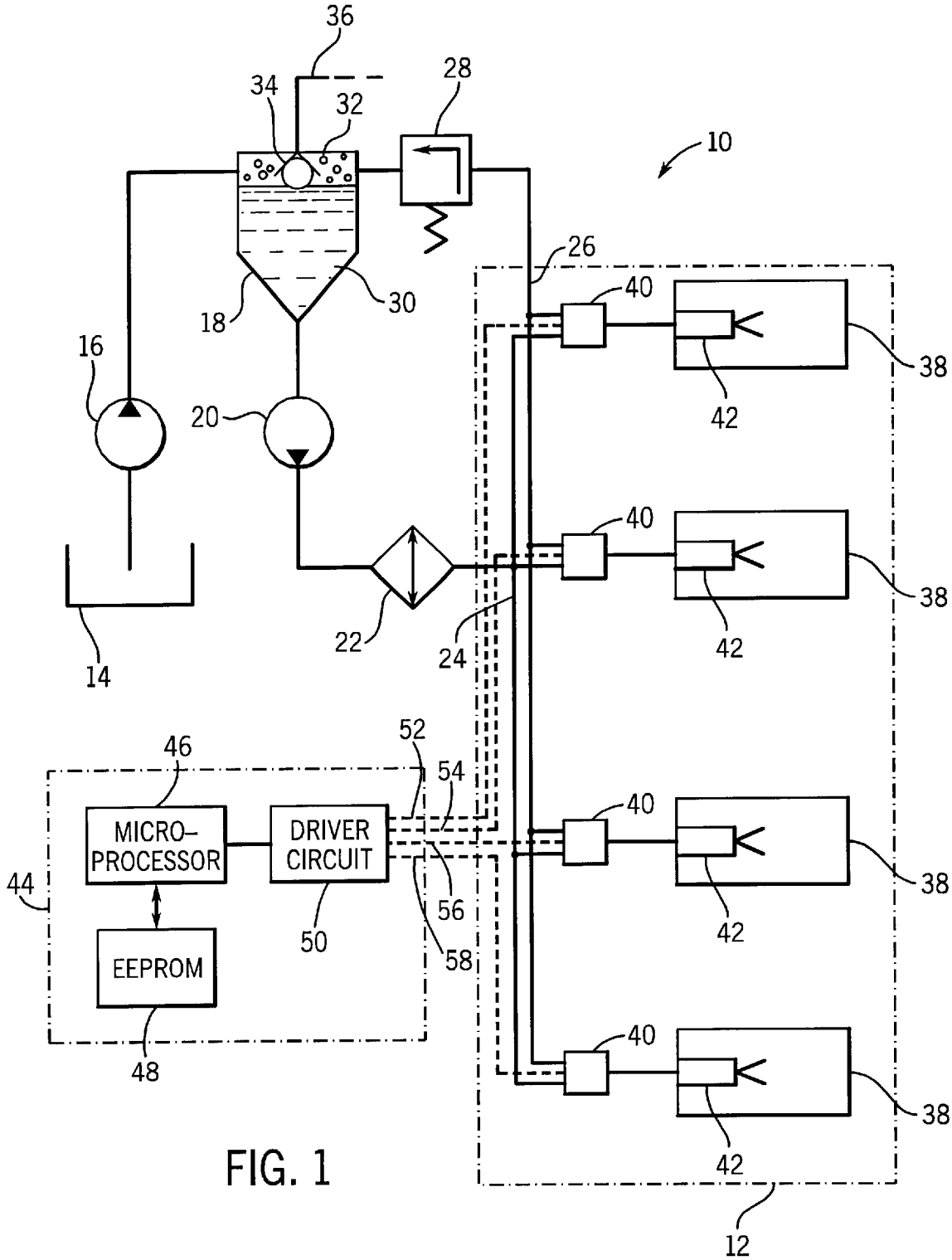
FIG. 1 is a schematic representation of a fuel delivery system utilizing a plurality of fuel delivery assemblies in accordance with certain aspects of the present technique.

Turning now to the drawings and referring first to FIG. 1, a fuel injection system 10 is illustrated diagrammatically, including a series of pumps for displacing fuel under pressure in an internal combustion engine 12. While the fluid pumps of the present technique may be employed in a wide variety of settings, they are particularly well suited to fuel injection systems in which relatively small quantities of fuel are pressurized cyclically to inject the fuel into combustion chambers of an engine as a function of the engine demands. The pumps may be employed with individual combustion chambers as in the illustrated embodiment, or may be associated in various ways to pressurize quantities of fuel, as in a fuel rail, feed manifold, and so forth. Even more generally, the present pumping technique may be employed in settings other than fuel injection, such as for displacing fluids under pressure in response to electrical control signals used to energize coils of a drive assembly, as described below. Moreover, the system 10 and engine 12 may be used in any appropriate setting, and are particularly well suited to two-stroke applications such as marine propulsion, outboard motors, motorcycles, scooters, snowmobiles and other vehicles.

In the embodiment shown in FIG. 1, the fuel injection system 10 includes a fuel reservoir 14, such as a tank for containing a reserve of liquid fuel. A first pump 16 draws the fuel from the reservoir, and delivers the fuel to a separator 18. While the system may function adequately without a separator 18, in the illustrated embodiment, separator 18 serves to insure that the fuel injection system downstream receives liquid fuel, as opposed to mixed phase fuel. A second pump 20 draws the liquid fuel from separator 18 and delivers the fuel, through a cooler 22, to a feed or inlet manifold 24. Cooler 22 may be any suitable type of fluid cooler, including both air and liquid heater exchangers, radiators, and so forth.

Fuel from the feed manifold 24 is available for injection into combustion chambers of the engine 12, as described more fully below. A return manifold 26 is provided for recirculating fluid not injected into the combustion chambers of the engine. In the illustrated embodiment a pressure regulating valve 28 is placed in series in the return manifold line 26 for maintaining a desired pressure within the return manifold. Fluid returned via the pressure regulating valve 28 is recirculated into the separator 18 where the fuel collects in liquid phase as illustrated at reference numeral 30. Gaseous phase components of the fuel, designated by referenced numeral 32 in FIG. 1, may rise from the fuel surface and, depending upon the level of liquid fuel within the separator, may be allowed to escape via a float valve 34. A vent 36 is provided for permitting the escape of gaseous components, such as for repressurization, recirculation, and so forth.

The engine 12 includes a series of combustion chambers or cylinders 38 for driving an output shaft (not shown) in rotation. As will be appreciated by those skilled in the art, depending upon the engine design, pistons (not shown) are driven in a reciprocating fashion within each combustion chamber in response to ignition of fuel within the combustion chamber. In two-stroke applications, the stroke of the piston within the chamber will permit fresh air for subsequent combustion cycles to be admitted into the chamber, while scavenging combustion products from the chamber. While in a present embodiment engine 12 employs a straightforward two-stroke engine design, the present technique may be adapted for a wide variety of applications and engine designs, including other than two-stroke engines and cycles.

In the illustrated embodiment, a reciprocating pump 40 is associated with each combustion chamber, drawing pressurized fuel from the feed manifold 24, and further pressurizing the fuel for injection into the respective combustion chamber. A nozzle 42 is provided for atomizing the pressurized fuel downstream of each reciprocating pump 40. While the present technique is not intended to be limited to any particular injection system or injection scheme, in the illustrated embodiment a pressure pulse created in the liquid fuel forces a fuel spray to be formed at the mouth or outlet of the nozzle, for direct, in-cylinder injection. The pumps 40 are activated by energizing drive signals which cause their reciprocation in any one of a wide variety of manners as described more fully below.

The operation of reciprocating pumps 40 is controlled by an electronic control unit (ECU) 44. The ECU 44, will typically include a programmed microprocessor 46 or other digital processing circuitry, a memory device such as EEPROM 48 for storing a routine employed in providing command signals from the microprocessor 46, and a driver circuit 50 for processing commands or signals from the microprocessor 46. The driver circuit 50 is constructed with multiple circuits or channels. Each individual channel corresponds with a reciprocating pump 40. A command signal is passed from the microprocessor 46 to the driver circuit 50.

The driver circuit 50, in response to the command signal, generates separate drive signals for each channel. These signals are carried to each individual pump 40 as represented by individual electric connections 52, 54, 56, and 58. Each of these connections corresponds with a channel of the driver circuit 50. The operation and logic of the ECU 44 will be discussed in greater detail below.

Figure 2:
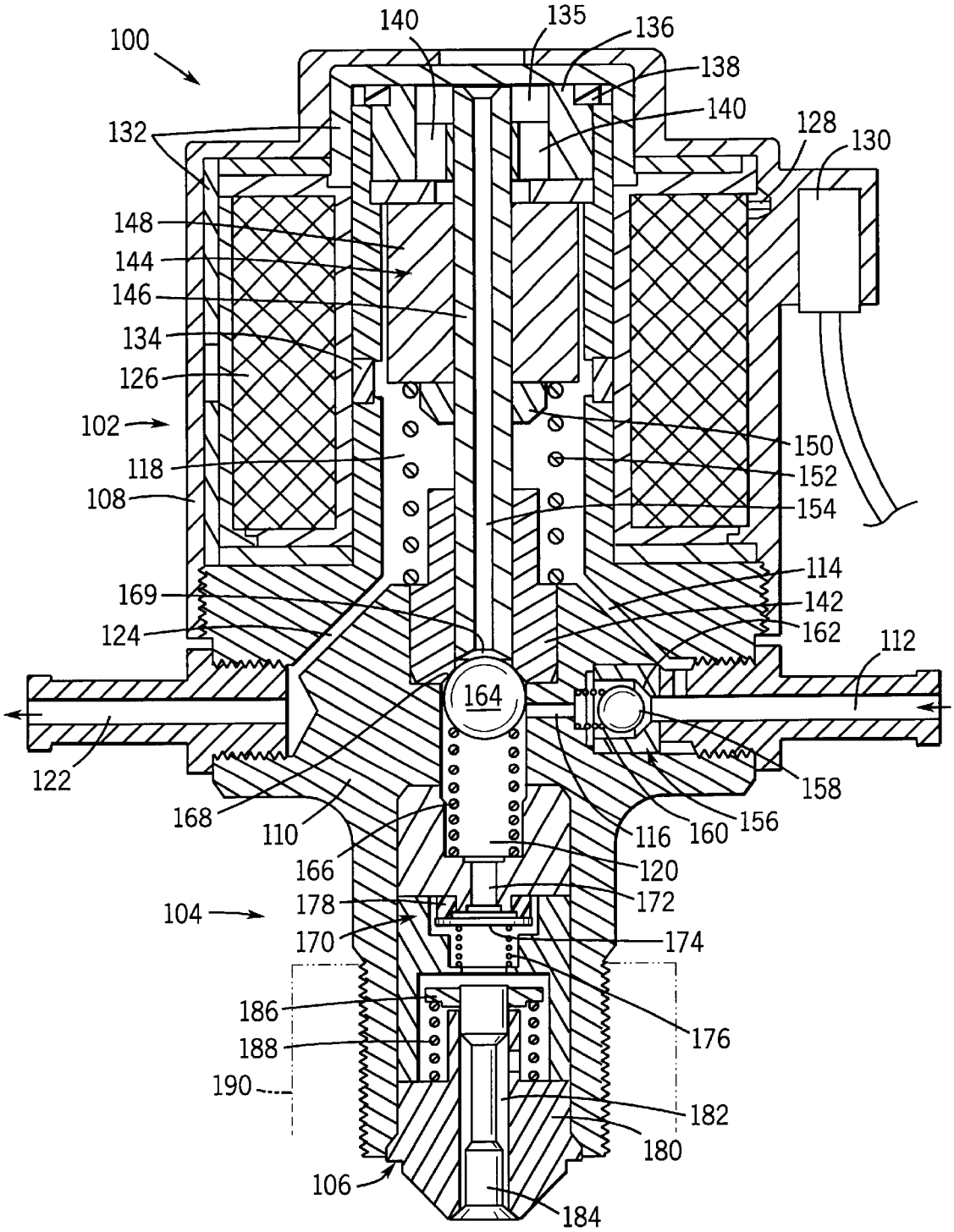
FIG. 2 is a cross-sectional view of a pump-nozzle assembly for use in the system of FIG. 1 at a point during the charging phase of the pump-nozzle assembly in accordance with an embodiment of the technique.
Figure 3:
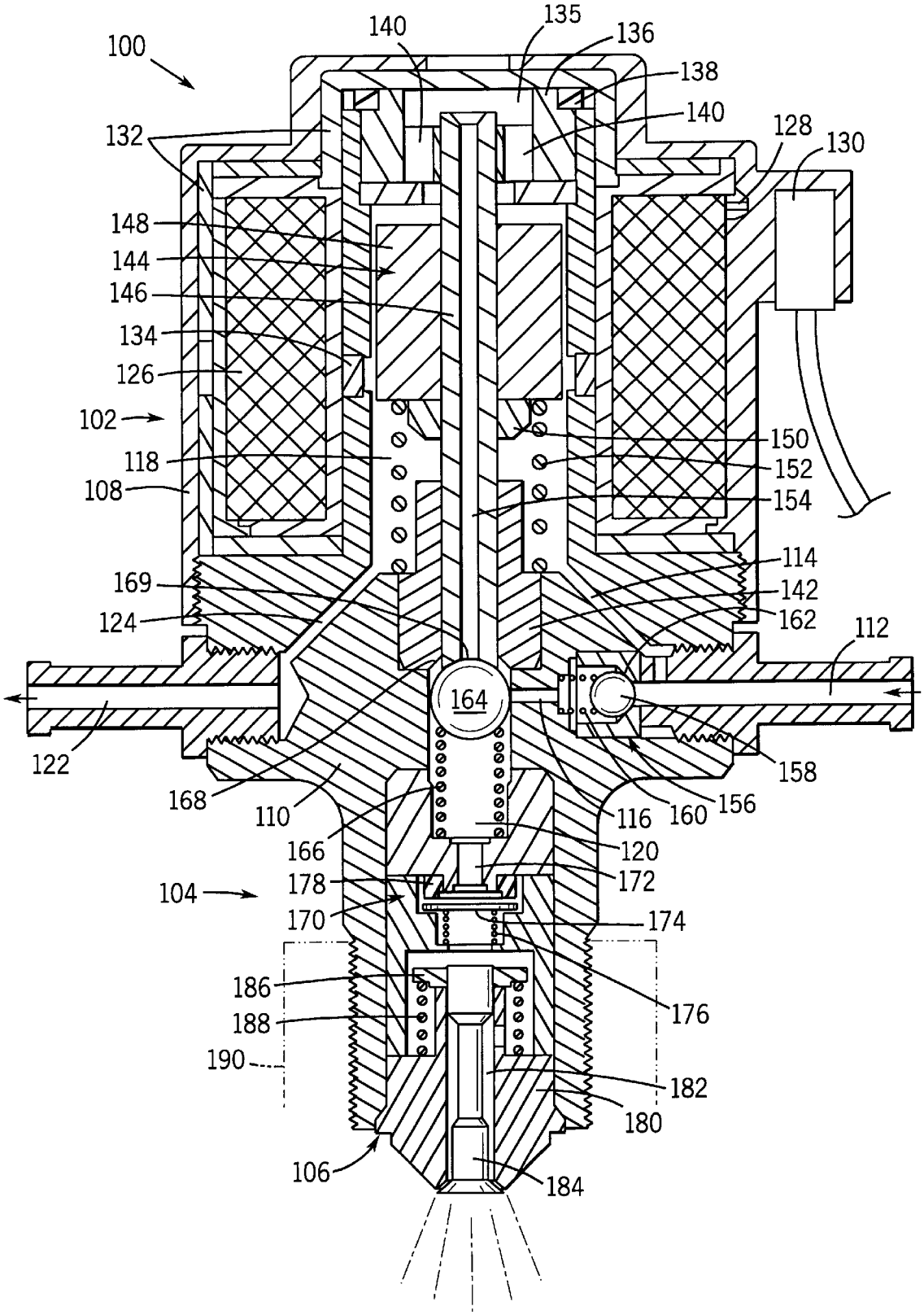
FIG. 3 is a cross-sectional view of a pump-nozzle assembly for use in the system of FIG. 1 at a point during the discharging phase of the pump-nozzle assembly.

Turning now to FIGS. 2 and 3, an exemplary reciprocating pump assembly, such as for use in a fuel injection system of the type illustrated in FIG. 1, is shown. Specifically, FIG. 2 illustrates the internal components of a pump assembly including a drive section and a pumping section in a first position wherein fuel is introduced into the pump for pressurization. FIG. 3 illustrates the same pump following energization of a solenoid coil to drive a reciprocating assembly and thus cause pressurization of the fuel and its expulsion from the pump. It should be borne in mind that the particular configurations illustrated in FIGS. 2 and 3 are intended to be exemplary only. Other variations on the pump may be envisaged, particularly variants on the components used to pressurize the fluid and to deliver the fluid to a downstream application.

Referring to FIG. 2, an embodiment is shown wherein the fluid actuators and fuel injectors are combined into a single unit, or pump-nozzle assembly 100. The pump-nozzle assembly 100 is composed of three primary subassemblies: a drive section 102, a pump section 104, and a nozzle 106. The drive section 102 is contained within a solenoid housing 108. A pump housing 110 serves as the base for the pump-nozzle assembly 100. The pump housing 110 is attached to the solenoid housing 108 at one end and to the nozzle 106 at an opposite end.

There are several flow paths for fuel within pump-nozzle assembly 100. Initially, fuel enters the pump-nozzle assembly 100 through the fuel inlet 112. Fuel can flow from the fuel inlet 112 through two flow passages, a first passageway 114 and a second passageway 116. A portion of fuel flows through the first passageway 114 into an armature chamber 118. For pumping, fuel also flows through the second passageway 116 to a pump chamber 120. Heat and vapor bubbles are carried from the armature cavity 118 by fuel flowing to an outlet 122 through a third fluid passageway 124. Fuel then flows from the outlet 122 to the common return line 26 (see FIG. 1).

The drive section 102 incorporates a linear electric motor. In the illustrated embodiment, the linear electric motor is a reluctance gap device. In the present context, reluctance is the opposition of a magnetic circuit to the establishment or flow of a magnetic flux. A magnetic field and circuit are produced in the motor by electric current flowing through a coil 126. The coil 126 receives power from the injection controller 44 (see FIG. 1). The coil 126 is electrically coupled by leads 128 to a receptacle 130. The receptacle 130 is coupled by conductors (not shown) to the ECU 44. Magnetic flux flows in a magnetic circuit 132 around the exterior of the coil 126, when the coil is energized. The magnetic circuit 132 is composed of a material with a low reluctance, typically a magnetic material, such as ferromagnetic alloy, or other magnetically conductive materials. A gap in the magnetic circuit 132 is formed by a reluctance gap spacer 134 composed of a material with a relatively higher reluctance than the magnetic circuit 132, such as synthetic plastic.

A reciprocating assembly 144 forms the linear moving elements of the reluctance motor. The reciprocating assembly 144 includes a guide tube 146, an armature 148, a centering element 150 and a spring 152. The guide tube 146 is supported at the upper end of travel by the upper bushing 136 and at the lower end of travel by the lower bushing 142. An armature 148 is attached to the guide tube 146. The armature 148 sits atop a biasing spring 152 that opposes the downward motion of the armature 148 and surge tube 146, and maintains the guide tube and armature in an upwardly biased or retracted position. Centering element 150 keeps the spring 152 and armature 148 in proper centered alignment. The guide tube 146 has a central passageway 154 which permits the flow of a small volume of fuel when the surge tube 146 moves a given distance through the armature chamber 118 as described below. Flow of fuel through the guide tube 146 permits its acceleration in response to energization of the coil during operation.

When the coil 126 is energized, the magnetic flux field produced by the coil 126 seeks the path of least reluctance. The armature 148 and the magnetic circuit 132 are composed of a material of relatively low reluctance. The magnetic flux lines will thus extend around coil 126 and through magnetic circuit 132 until the magnetic gap spacer 134 electromagnetic force will be produced to drive the armature 148 downward towards alignment with the reluctance gap spacer 134. When the flow of electric current is removed from the coil by the injection controller 44, the magnetic flux will collapse and the force of spring 152 will drive the armature 148 upwardly and away from alignment with the reluctance gap spacer 134. Cycling the electrical control signals provided to the coil 126 produces a reciprocating linear motion of the armature 148 and guide tube 146 by the upward force of the spring 152 and the downward force produced by the magnetic flux field on the armature 148.

During the return motion of the reciprocating assembly 144 a fluid brake within the pump-nozzle assembly 100 acts to slow the upward motion of the moving portions of the drive section 102. The upper portion of the solenoid housing 108 is shaped to form a recessed cavity 135. An upper bushing 136 separates the recessed cavity 135 from the armature chamber 118 and provides support for the moving elements of the drive section at the upper end of travel. A seal 138 is located between the upper bushing 136 and the solenoid housing 108 to ensure that the only flow of fuel from the armature chamber 118 to and from the recessed cavity 135 is through fluid passages 140 in the upper bushing 136. In operation, the moving portions of the drive section 102 will displace fuel from the armature chamber 118 into the recessed cavity 135 during the period of upward motion. The flow of fuel is restricted through the fluid passageways 140, thus, acting as a brake on upward motion. A lower bushing 142 is included to provide support for the moving elements of the drive section at the lower travel limit and to seal the pump section from the drive section.

While the first fuel flow path 114 provides proper dampening for the reciprocating assembly as well as providing heat transfer benefits, the second fuel flow path provides the fuel for pumping and, ultimately, for combustion. The drive section 102 provides the motive force to drive the pump section 104 which produces a surge of pressure that forces fuel through the nozzle 106. As described above, the drive section 102 operates cyclically to produce a reciprocating linear motion in the guide tube 146. During a charging phase of the cycle, fuel is drawn into the pump section 104. Subsequently, during a discharging phase of the cycle, the pump section 104 pressurizes the fuel and discharges the fuel through the nozzle 106, such as directly into a combustion chamber 38 (see FIG. 1).

During the charging phase fuel enters the pump section 104 from the inlet 112 through an inlet check valve assembly 156. The inlet check valve assembly 156 contains a ball 158 biased by a spring 160 toward a seat 162. During the charging phase the pressure of the fuel in the fuel inlet 112 will overcome the spring force and unseat the ball 158. Fuel will flow around the ball 158 and through the second passageway 116 into the pump chamber 120. During the discharging phase the pressurized fuel in the pump chamber 120 will assist the spring 160 in seating the ball 158, preventing any reverse flow through the inlet check valve assembly 156.

A pressure surge is produced in the pump section 104 when the guide tube 146 drives a pump sealing member 164 into the pump chamber 120. The pump sealing member 164 is held in a biased position by a spring 166 against a stop 168. The force of the spring 166 opposes the motion of the pump sealing member 164 into the pump chamber 120. When the coil 126 is energized to drive the armature 148 towards alignment with the reluctance gap spacer 134, the guide tube 146 is driven towards the pump sealing member 164. There is, initially, a gap 169 between the guide tube 146 and the pump sealing member 164. Until the guide tube 146 transits the gap 169 there is essentially no increase in the fuel pressure within the pump chamber 120, and the guide tube and armature are free to gain momentum by flow of fuel through passageway 154. The acceleration of the guide tube 146 as it transits the gap 169 produces the rapid initial surge in fuel pressure once the surge tube 146 contacts the pump sealing member 164, which seals passageway 154 to pressurize the volume of fuel within the pump chamber.

Referring generally to FIG. 3, a seal is formed between the guide tube 146 and the pump sealing member 164 when the guide tube 146 contacts the pump sealing member 164. This seal closes the opening to the central passageway 154 from the pump chamber 120. The electromagnetic force driving the armature and guide tube overcomes the force of springs 152 and 166, and drives the pump sealing member 164 into the pump chamber 120. This extension of the guide tube into the pump chamber causes an increase in fuel pressure in the pump chamber 120 that, in turn, causes the inlet check valve assembly 156 to seat, thus stopping the flow of fuel into the pump chamber 120 and ending the charging phase. The volume of the pump chamber 120 will decrease as the guide tube 146 is driven into the pump chamber 120, further increasing pressure within the pump chamber and forcing displacement of the fuel from the pump chamber 120 to the nozzle 106 through an outlet check valve assembly 170. The fuel displacement will continue as the guide tube 146 is progressively driven into the pump chamber 120.

Pressurized fuel flows from the pump chamber 120 through a passageway 172 to the outlet check valve assembly 170. The outlet check valve assembly 170 includes a valve disc 174, a spring 176 and a seat 178. The spring 176 provides a force to seat the valve disc 174 against the seat 178. Fuel flows through the outlet check valve assembly 170 when the force on the pump chamber side of the disc produced by the rise in pressure within the pump chamber is greater than the force placed on the outlet side of the valve disc 174 by the spring 176 and any residual pressure within the nozzle.

Once the pressure in the pump chamber 120 has risen sufficiently to open the outlet check valve assembly 170, fuel will flow from the pump chamber 120 to the nozzle 106. The nozzle 106 is comprised of a nozzle housing 180, a passage 182, a poppet 184, a retainer 186, and a spring 188. The poppet 184 is disposed within the passage 182. The retainer 186 is attached to the poppet 184, and spring 188 applies an upward force on the retainer 186 that acts to hold the poppet 184 seated against the nozzle housing 180. A volume of fuel is retained within the nozzle 106 when the poppet 184 is seated. The pressurized fuel flowing into the nozzle 106 from the outlet check valve assembly 170 pressurizes this retained volume of fuel. The increase in fuel pressure applies a force that unseats the poppet 184. Fuel flows through the opening created between the nozzle housing 180 and the poppet 184 when the poppet 184 is unseated. The inverted cone shape of the poppet 184 atomizes the fuel flowing from the nozzle in the form of a spray. The pump-nozzle assembly 100 is preferably threaded to allow the pump-nozzle assembly to be screwed into a cylinder head 190. Thus, the fuel spray from the nozzle 106 may be injected directly into a cylinder.

When the drive signal or current applied to the coil 126 is removed, the drive section 102 will no longer drive the armature 148 towards alignment with the reluctance gap spacer 134, ending the discharging phase and beginning a subsequent charging phase. The spring 152 will reverse the direction of motion of the armature 148 and guide tube 146 away from the reluctance gap spacer 134. Retraction of the guide tube from the pump chamber 120 causes a drop in the pressure within the pump chamber, allowing the outlet check valve assembly 170 to seat. The poppet 184 similarly retracts and seats, and the spray of fuel into the cylinder is interrupted. Following additional retraction of the guide tube, the inlet check valve assembly 156 will unseat and fuel will flow into the pump chamber 120 from the inlet 112. The operating cycle the pump-nozzle assembly 100 is thus returned to the condition shown in FIG. 2.

Figure 4:
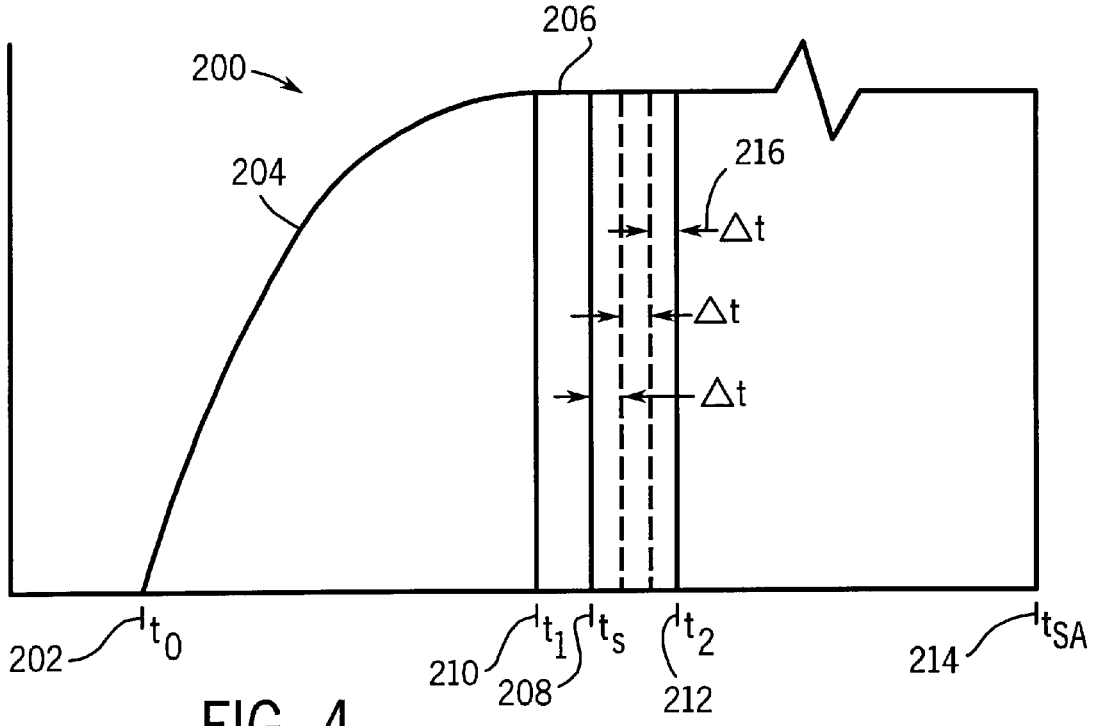
FIG. 4 is a graphical current vs. time representation of the input signal for multiple channels of an ECU in accordance with certain aspects of the present technique.

Typically, the drive signals supplied to the coil 126 by the ECU 44 will be in the form of short pulses. The ECU 44 can establish the volume per injection by the duration of the drive signal pulse. The flow rate of fuel can be controlled by the duration and frequency of the pulses. As illustrated graphically in FIG. 4, the drive signal supplied by the ECU 44 is generally ramped to provide the desired operation of the pump as described above. FIG. 4 shows a typical current trace 200 representative of a drive signal provided by the ECU 44. The vertical axis in FIG. 4 represents the current being applied to the coil 126 (see FIG. 3) while the horizontal axis represents the elapsed time of a cycle of operation. The trace 200 is representative of the drive signal for one cycle of operation and for one ECU channel as described above.

At time $t_0$, as indicated at reference number 202, current is applied to the coil 126 of the pump-nozzle assembly 100. The current rises for a period of time as indicated by the portion of the curve shown at 204 until it reaches a desired level at time $t_1$, as indicated at 206. The current is sustained at the desired level until the current is terminated at time $t_S$ indicated by reference number 208. At this time, the coil 126 is no longer energized and the biasing spring 166 returns the reciprocating assembly 144 to its initial position to await energization in another cycle (see FIGS. 2 and 3). In a present embodiment, the profile of the drive signal trace is defined by an R-C and comparator circuit of a type generally known in the art, although other analog or digital circuits and arrangements may be used, along with different or specially-adapted drive signal profiles.

The nature of the drive signal, particularly during the duration from $t_0$ to $t_S$ dictates various performance characteristics of the injection process. For example, the current applied to the coil produces the force generated by the coil to drive the reciprocation assembly 144. Also, the time duration from $t_0$ to $t_S$ determines the cycle time for the pump-nozzle assembly. Furthermore, the area under the signal trace 200 for the duration of $t_0$ to $t_S$ is generally representative of the volume of fuel which is discharged into a combustion chamber in a single cycle. Accurate control of these parameters is desirable in increasing the performance of a fuel injection system and associated internal combustion. By altering the signal duration, the ECU may alter the quantity of fuel injected in each cycle of operation.

It is noted that the signal trace 200 is representative of the desired drive signal expected to result from the ECU 44. However, because of tolerances and other variability in circuitry components, the actual signal may vary from channel to channel. For example, for a known command signal generated by the microprocessor 46, all channels will ideally supply a corresponding drive signal which takes the form shown in FIG. 4 and denoted by the horizontal boundaries of $t_0$ and $t_S$. However, in practice, some channels may produce signals of different durations, such as a trace bounded on the horizontal axis by $t_0$ and $t_1$, (i.e. a shortened drive signal). Similarly, other channels may produce drive signals graphically bound on the horizontal axis by $t_0$ and $t_2$, as indicated by reference numeral 212 (i.e. an extended drive signal). In each case, the signal varies from that which is expected, and may be different from or inconsistent with signals produced by the other channels, resulting in variations in the predicted or desired performance from one ECU to another, as well as from one channel to another of a given ECU. It should also be noted that, in practice in a present design, the ECU actually does not vary in pulse width from channel to channel. As will be appreciated by those skilled in the art, this is controlled by a precise timer. However, variation results from the rising current into the injector. The measurement and control of this rising current varies somewhat due to component tolerances, but more so in the variation and noise of the current paths in each circuit (actual copper traces) in the circuit board. Finally, in application, the current trace in FIG. 4 may not level off as shown, but may continue to rise with a smaller slope as time increases.

The effect of such variations may be characterized by analyzing the area under the signal curve. In the two scenarios discussed above, a first channel producing a shortened drive signal would produce an injection event having a smaller volume of discharged fuel than expected, while a second channel producing an extended signal would produce an injection event having a larger volume of discharged fuel than expected. This would result in inferior engine performance, such as, for example, unpredictable and inconsistent torque output. It is noted, that in injection signals having long durations, such as that shown by the curve bound on the horizontal axis by $t_0$ and $t_{SA}$, as indicated at 214, a variation from one channel to another will have lesser effect. This is because such a signal trace has a much larger overall area bound by the trace and the horizontal axis, resulting in a relatively greater quantity of fuel injected in the corresponding cycle. In such cases, for a given variation, there is a relatively smaller percentage change in area, thus, representing a smaller error in fuel discharged on a percentage basis. Therefore, in injection events which are resultant of a drive signal having an increased duration, the detrimental effects such variations may be diminished. However, it is often desirable to have injection volumes per cycle, resulting in relatively greater variations from the desired performance and an increase in such detrimental effects.

Figure 5:
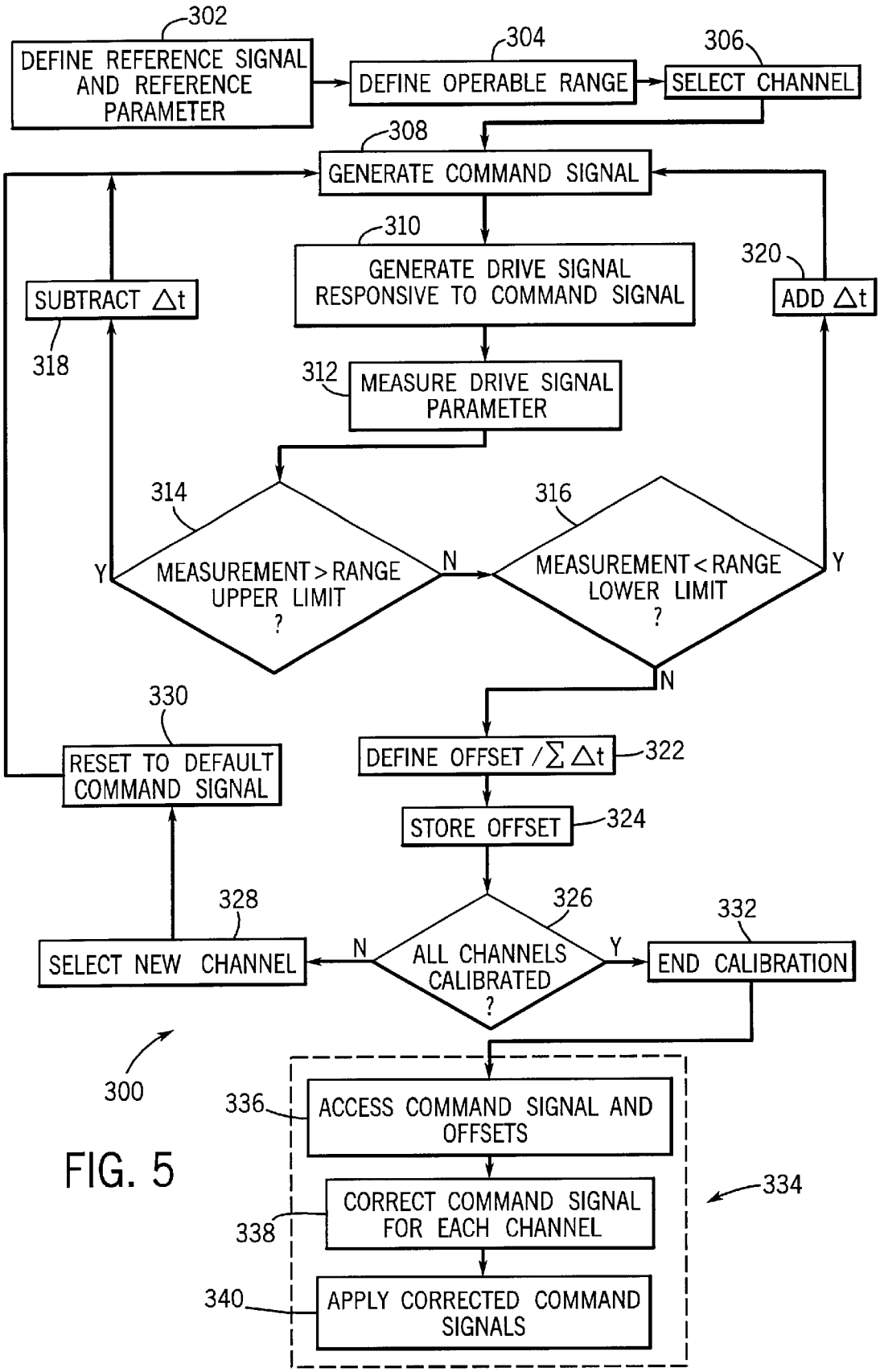
FIG. 5 is a flow chart illustrating exemplary logical steps in a process for calibrating channels of an ECU in accordance with aspects of the present technique.

An exemplary method of calibrating the ECU 44, as well as individual channels on the ECU is shown in the logic diagram of FIG. 5 with some reference to the signal curve of FIG. 4 and the overall system diagram of FIG. 1. The logic sequence 300 begins with the process of defining a reference signal as indicated at 302. The reference signal may correspond to a known or ideal signal produced by a reference or standard ECU 44 such as the signal represented in FIG. 4 horizontally bound by $t_0$ to $t_S$. The reference signal will also have a known reference parameter (e.g. area under the signal trace) for later comparison. As noted above, this drive signal is expected in response to a command signal supplied by the microprocessor. While it is desirable to reproduce the reference signal exactly, it is often difficult to do so. The present technique therefore permits calibration of each ECU channel to compensate for channel-to-channel variations, and thereby to produce signals which fall within a predefined range associated with the reference signal. This range is then defined as indicated by step 304. Steps 302 and 304 will typically be performed upon installation or programming of a calibration station or interface, such as in the ECU manufacturing or servicing location.

A channel of the driver circuit 50 is then selected for calibration at step 306. A command signal is generated by the microprocessor at step 308. The command signal is sent to the driver circuit 50 such that a drive signal is generated in response for the selected channel as shown at 310. At step 312 a desired parameter of the drive signal is then measured. This parameter may be any of a number of characteristics associated with the drive signal, however in the illustrated example it is the area under the signal trace as described above in conjunction with FIG. 4. Variations in the channel tending to shorten the drive signal will result in a smaller measured area, whereas variations tending to extend the signal will result in a great area, in each case for the same or standard command signal.

Having measured the desired parameter of the drive signal, comparison is now made with the known reference parameter obtained at step 302. At decision step 314 the it is determined whether the measured parameter is greater than the upper limit of the defined range. If the measured parameter is not greater than the upper limit of the defined range, the logic advances to decision step 316. However, if the measured parameter is greater than the upper limit of the defined range (i.e. the drive signal is undesirably extended), then the command signal is modified by effectively subtracting a small, standard increment of time, $\Delta t$ (as indicated by reference number 216 in FIG. 4), from the command signal to produce a modified drive signal duration, as indicated at step 318 of FIG. 5. This scenario may be illustrated with reference to FIG. 4 where the measured signal is represented by the curve bounded by $t_0$ and $t_2$. Assuming, for sake of illustration, that the defined range is equivalent to the area represented by $t_0$ and $t_S$. then the measurement would be beyond the upper limit of the defined range by approximately three durations $\Delta t$.

Similarly, decision step 316 seeks to determine whether the measured parameter is less than the lower limit of the defined range. If the measurement is lower, then a similar process to that described above occurs, except that an effective $\Delta t$ is added to the drive signal at step 320. If it is required to either add or subtract an increment of $\Delta t$ as indicated at step 320 or 318 respectively, then the process reverts to step 308 wherein a modified command signal is generated to produce the presently desired drive signal. This process is iterative until both decision steps 314 and 316 are satisfied and step 322 is reached.

At step 322 an offset is defined. The offset is defined to be the summation of all modifications made during the previous iterations for the channel being calibrated. For example, in FIG. 4, the curve horizontally bound by $t_0$ and $t_2$ might require 3 iterations of subtracting an effective Δt to come within the desired area range. Thus the offset would be defined to represent an effective subtraction of 3Δt. This offset is then stored at step 324 in a memory device such as the EEPROM 48 of FIG. 1. The step of storing the offset completes the calibration for the selected channel. It is then determined, as indicated at decision step 326, whether all channels of the ECU have been calibrated. If there are further channels to be calibrated then a new channel is selected 328. Having selected a new channel, the command signal is reset at step 330 to the default signal which is the same signal defined at 302. The process is then iterative until all channels have been calibrated, each having an independent offset stored in memory. Δt this point calibration is complete for the ECU as indicated at 332.

Subsequent use of the calibrated ECU is indicated generally at 334. When the ECU is being utilized the defined offsets for each channel will be accessed as indicated at 336. As indicated at step 338, the command signal for each channel will then be corrected according to the associated offset for each particular channel. Finally, as shown at 340, the corrected command signals will then be applied such that the resultant drive signals are all within the defined range when compared to the reference signal. An ECU calibrated by such a method as described above will be more predictable and have less variance from one channel to another, as well as from one ECU to another. Likewise, internal combustion engines utilizing ECU's calibrated according to the method described herein will perform more predictably, consistently, and efficiently.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims. For example, in the foregoing discussion, a technique was set forth in which the duration of a pulse, or pulse width, was varied to compensate for deviations from expected performance. Other techniques may be employed in accordance with the present invention, wherein software and/or hardware adjustments are made for the same purpose by properly compensating for part-to-part differences within the ECU. In hardware, for instance, a resistor could be trimmed or adjusted to affect the rate of rise of current. If this is done in hardware, no memory means may be necessary due to the reduced need for modification of the signal through software. In another software solution, the rate of rise of current may be controlled through specific driver circuitry. In particular, where a precise voltage is supplied to a current to provide a desired waveform, the voltage may be adjusted slightly for each channel. The latter technique may employ individual voltage supplies to modify the voltages applied to the channels independently. In all of these cases, however, the present technique characterizes and compensates for channel-to-channel variation by appropriate adjustment of signals used to drive the fuel delivery apparatus.

What is claimed is:

1. A method of calibrating a channel of an electronic control unit for an internal combustion engine, the channel being adapted to provide a drive signal to a fuel delivery apparatus, the method comprising:

(a) defining a reference drive signal having a known parameter which is indicative of cyclical performance of the fuel delivery apparatus;

(b) generating a command signal;

(c) generating the drive signal in response to the command signal;

(d) measuring a parameter of the drive; signal and comparing the measured parameter with the known reference parameter; and (e) adjusting the command signal to a modified drive signal based upon the comparison.

2. The method of claim 1, wherein adjusting the command signal includes modifying a duration of the command signal.

3. The method of claim 2, wherein the duration of the command signal is modified by a predetermined incremental amount.

4. The method of claim 3, wherein steps (b) through (e) are performed iteratively until the measured parameter of the drive signal falls within a desired range of the known reference parameter.

5. The method of claim 2, wherein the duration of the command signal is modified by an amount dependent upon deviation of the measured parameter of the drive signal from the known reference parameter.

6. The method of claim 2, further comprising storing a value representative of the modification to the duration of the command signal.

7. The method of claim 1, further comprising storing a value representative of the adjusted command signal.

8. The method of claim 1, wherein the duration of the command signal is modified by increments of approximately $100\mu$ seconds.

9. The method of claim 1, wherein the measured parameter is an integral of the drive signal in terms of current versus time.

10. A method of calibrating an electronic control unit for an internal combustion engine, the electronic control unit having multiple channels, each channel being adapted to provide an input drive signal to a fuel delivery apparatus, the method comprising:

(a) selecting a first channel for calibration;

(b) defining a reference drive signal having a known parameter which is indicative of cyclical performance of the fuel delivery apparatus;

(c) generating a command signal;

(d) generating the drive signal in response to the command signal;

(e) measuring a parameter of the drive signal and comparing the measured parameter with the known reference parameter for any variation; and (f) adjusting the command signal based upon the comparison to reduce variation from the known reference parameter.

11. The method of claim 10, wherein adjusting the command signal includes modifying a duration of the command signal.

12. The method of claim 11, wherein the duration of the command signal is modified by a predetermined incremental amount.

13. The method of claim 12, wherein steps (c) through (f) are performed iteratively until the measured parameter of the drive signal for the first channel falls within a desired range of the known reference parameter.

14. The method of claim 13, further comprising storing a value representative of the modification to the duration of the command signal.

15. The method of claim 14, further comprising selecting a second channel and repeating steps (b)–(f) for the second channel.

16. The method of claim 15, wherein steps (c) through (f) are performed iteratively until the measured parameter of the drive signal for the second channel falls within a desired range of the known reference parameter.

17. The method of claim 13, further comprising storing a value representative of the adjusted command signal.

18. The method of claim 17, further comprising selecting a second channel and repeating steps (b)–(f) for the second channel.

19. The method of claim 18, wherein steps (c) through (f) are performed iteratively until the measured parameter of the drive signal for the second channel falls within a desired range of the known reference parameter.

20. The method of claim 11, wherein the duration of the command signal is modified by an amount dependent upon the deviation of the measured parameter of the drive signal form the known reference parameter.

21. The method of claim 11, further comprising storing a value representative 6f the adjusted command signal.

22. The method of claim 11, wherein the duration of the command signal is modified by increments of approximately $100\mu$ seconds.

23. The method of claim 10, wherein the measured parameter is a time integral of the drive signal.

24. An electronic control unit for an internal combustion unit, the electronic control unit having a channel being adapted to provide a drive signal to a fuel delivery apparatus, comprising:

(a) means for defining a reference drive signal having a known parameter which is indicative of cyclical performance of the fuel delivery apparatus;

(b) means for generating a command signal;

(c) means for generating the drive signal in response to the command signal;

(d) means for measuring a parameter of the drive signal and comparing the measured parameter with the known reference parameter; and (e) means for adjusting the command signal to a modified drive signal based upon the comparison.

* * * * *